United States Patent [19]

Lotspeich

[11] Patent Number: 4,506,802

[45] Date of Patent: Mar. 26, 1985

[54] SHELF CONFIGURATION FOR VENDING MACHINES

[75] Inventor: Joseph A. Lotspeich, Inver Grove Heights, Minn.

[73] Assignee: Gross-Given Manufacturing Company, Saint Paul, Minn.

[21] Appl. No.: 504,266

[22] Filed: Jun. 14, 1983

[51] Int. Cl.[3] ..... G07F 11/36

[52] U.S. Cl. ..... 221/75; 222/410

[58] Field of Search ..... 221/75, 261, 311, 312 R; 198/475; 222/410

[56] References Cited

U.S. PATENT DOCUMENTS

| | | | |
|---|---|---|---|
| 2,627,140 | 2/1953 | Marzolf | 51/22 |
| 3,085,711 | 4/1963 | Holstein et al. | 221/75 |
| 3,335,907 | 8/1967 | Holstein et al. | 221/6 |
| 3,441,174 | 4/1969 | Kenney | 221/75 |
| 3,591,045 | 7/1971 | Sturrock | 221/75 |
| 3,653,540 | 4/1972 | Offutt | 221/75 |
| 3,840,147 | 10/1974 | O'Neal et al. | 221/75 |
| 3,861,561 | 1/1975 | Wittern et al. | 221/75 |
| 3,929,255 | 12/1975 | Wittern et al. | 221/75 |
| 3,952,915 | 4/1976 | Pitel et al. | 221/75 |
| 3,993,215 | 11/1976 | Cox et al. | 221/75 |
| 4,061,245 | 12/1977 | Lotspeich | 221/75 |
| 4,148,412 | 4/1979 | Lotspeich | 221/75 |
| 4,149,653 | 4/1979 | Lennartson | 221/75 |
| 4,368,829 | 1/1983 | Lotspeich et al. | 221/75 |

*Primary Examiner*—Joseph J. Rolla
*Assistant Examiner*—Michael S. Huppert
*Attorney, Agent, or Firm*—Merchant, Gould, Smith, Edell, Welter & Schmidt

[57] ABSTRACT

The support apparatus (39) for rotatably supporting an elongated semi-rigid helical (22) having a center longitudinal axis (52), of the type used for dispensing articles (38) from a dispensing machine, above a substantially planar shelf surface (34) having a front edge (36) is disclosed. The support apparatus (39) comprises a first coil support member (40) and a second coil support member (42) each defining a generally planar upper surface (41) and (43) respectively to lie above and generally parallel to a shelf surface (34) and adjacent a front end (36) thereof. The first and second coil support members (40 and 42) are disposed in spaced, generally parallel relationship to one another, and wherein the first and second coil support members (40 and 42) are laterally spaced apart from one another a sufficient distance to cooperatively support a helical coil on and between the first and second upper surfaces (40 and 42). During the dispensing of the article, the distances from the axis (52) of the coil (22) to the inner edges (40*a* and 42*a*) of the first and second coil support members (40 and 42) proximate where the coil (22) is supported respectively are less than the distances from the axis (52) of the coil (22) to the inner edges (40*a* and 42*a*) of the first and second coil support members (40 and 42) proximate the forwardmost convolution of the coil (22) respectively. During the dispensing cycle the forwardmost convolution of the coil (22) is not supported by the first and second coil support members (40 and 42).

6 Claims, 8 Drawing Figures

SHELF CONFIGURATION FOR VENDING MACHINES

BACKGROUND OF THE INVENTION

1. Field of the Invention

This invention relates generally to vending machines having helical dispensing coils, and more particularly to an improved shelf configuration for the forward end of a product shelf in such a machine comprising an improved support member for rotatably supporting the front end of an elongated helical coil above the surface of the shelf and the forwardmost convolution of the coil is not supported by the support member.

2. Description of the Prior Art

The use of helical coils in vending machines as a means for transporting articles to be vended from a location in the interior of the machine to a discharge point is well known. Typically, the vending coil is used in conjunction with a horizontal support tray or shelf. The articles to be vended are placed within the convolutions of the vending coil and are supported by the tray or shelf. Upon rotation of the vending coil, the articles to be dispensed is longitudinally advanced along the shelf until it reaches the front end of the shelf. Upon further rotation of the vending coil, the article to be dispensed is forced over the front edge of the shelf and falls into a discharge bin where it may be manually removed by the person operating the vending machine.

U.S. Pat. No. 3,993,215 to Cox et al illustrates a vending coil support structure typically used in the prior art. In the Cox structure, the dispensing coil rides within a trough formed within a shelf. The forward end of the shelf is configured to form a notch, when viewed above, with a forwardly projecting ledge at one side of the notch. The dispensing coil is disposed with its forward end extending over the notch and the lower end of its forwardmost convolution extending over the notch to support the next item to be dispensed at one side thereof above the notch, with the other side of the item being supported on the projecting ledge. During a dispensing cycle, as the coil rotates, the lower convolution portion which supports the item to be dispensed is withdrawn from beneath the item, allowing the item to tip sideways and to fall under the force of gravity through the notch and into an underlying collection bin.

The Cox apparatus was specifically designed for vending machines having relatively closer tolerances between the front of the helix and the front door of the cabinet, where it is desirable to cause the item being dispensed to tip to the "side" rather than "forward" during the dispensing cycle. This apparatus was particularly designed for dispensing relatively light-weight bag packaged articles such as potato chips, pretzels and the like whch would have a tendency to hang-up or become bridged between the shelf and the front door of the machine, if such articles would be dispensed so as to tip-over the forward longitudinal direction of the coil. While the side-tipping dispensing apparatus of Cox addressed the bridging problem associated with dispensing bag-type articles, the structure was susceptible to jamming or catching of the bag-type package being dispensed between the lower surface of the dispensing coil and the upper surface of the trough.

The inventor's prior U.S. patent application Ser. No. 669,348 filed Mar. 22, 1976, now issued as U.S. Pat. No. 4,061,245, described an improved helical-coil dispensing apparatus, generally operable in a side-tipping manner, which overcomes the jamming or catching deficiencies of the Cox-type apparatus. This apparatus does not require a coil-guide trough along the entire length of the dispensing coil, but has means for supporting the opposite ends of the dispensing coil such that the lowermost portions of the opposite ends are exposed above and spaced from the horizontal shelf surface on which the items to be dispensed are being supported. A coil support member mounted at the forward end of the shelf is configured to rotatably support the forward end of the coil such that the lower extremity of the coil does not engage the shelf surface, and thus cannot catch the package of the article being dispensed therebetween.

One type of such support member of the forward end of the dispensing shelf is disclosed in FIGS. 4–6 of the inventor's above-referenced prior patent. Such a support member includes two parallel, transversely spaced coil support members having upper planar surfaces disposed above the level of the shelf surface, for supporting the dispensing coil thereon. A first end of each of the coil support members is provided with an upwardly extending ramp which guides articles to be dispensed and moved by the coil from the primary shelf surface to the upper planar surfaces of the coil support members. A second end of one of the support members projects outwardly beyond the front end of the shelf, and the second end of the other coil support member terminates at a position approximately coincident with the front edge of the shelf. This forms, in effect, a laterally offset notch as viewed from above, at the forward end of the shelf. The article to be next dispened is supported and dispensed in a manner similar to that above-described with respect to the Cox apparatus.

The inventor's prior U.S. patent application Ser. No. 389,817 filed Oct. 6, 1977, now issued as U.S. Pat. No. 4,148,412, described a support apparatus comprising a first elongated coil support member transversely spaced from and parallel to a second elongated coil support member. The coil support members each terminated at coplanar ends which are connected together by means of a downwardly inclined ramp. One of the coil support members adjacent the downwardly inclined ramp has a beveled inner edge portion to allow at least some products moved by the coil to be oriented in a transversely tilted position immediately before dispensing. The coil support members were transversely spaced apart at a sufficient distance so as to cause the front portion of the dispensing coil to be supported by the upper planar surfaces of the coil support members, at a position spaced above the shelf space. However, the coil was still carried along its entire length by at least one of the coil support members. While this invention overcame the deficiencies of the prior art helical coil dispensing structures for dispensing heavy or boxed items, the support of the coil along its entire length provided for an opportunity for relatively light-weight bag packaged type items such as potato chips and pretzels to become caught at the dispensing end between the coil and the support member.

The present invention overcomes the deficiencies of the prior helical coil dispensing structures.

SUMMARY OF THE INVENTION

The present invention provides a support apparatus for rotatably supporting an elongated semi-rigid helical coil having a center longitudinal axis, of the type used for dispensing articles from a dispensing machine, above a substantially planar shelf surface having a front edge. The support apparatus comprises at first elongated coil support member defining a first generally planar upper surface disposed to lie about and generally parallel to a shelf surface and adjacent a front end thereof. The first upper surface being terminated at first and second longitudinally opposed ends thereof, the second end proximate the front edge. A second elongated coil support member defines a second generally planar upper surface disposed to lie about and generally parallel to the shelf surface and adjacent the front edge thereof. The second upper surface being terminated at first and second longitudinally opposed ends thereof, the second end proximate the front edge. The first and second coil support members are disposed in spaced, generally parallel relationship to one another, and wherein the first and second coil support members are laterally spaced apart from one another a sufficient distance to cooperatively support a helical coil on and between the first and second upper surfaces such that the lower surface of the supported coil is disposed to lie above and spaced apart from the shelf surface. The first and second coil support members each respectfully has a lateral width defined by inner and outer edges thereof extending between the first and second ends thereof. Wherein during the dispensing of the article, the distances from the axis of the coil to the inner edges of the first and second coil support members proximate where the coil is supported respectively are less than the distances from the axis of the coil to the inner edges of the first and second coil support members proximate the forwardmost convolution of the coil respectively. At least the forwardmost convolution of the coil is not supported by the first and second coil support members.

DESCRIPTION OF THE PREFERRED EMBODIMENT

Figure 1:
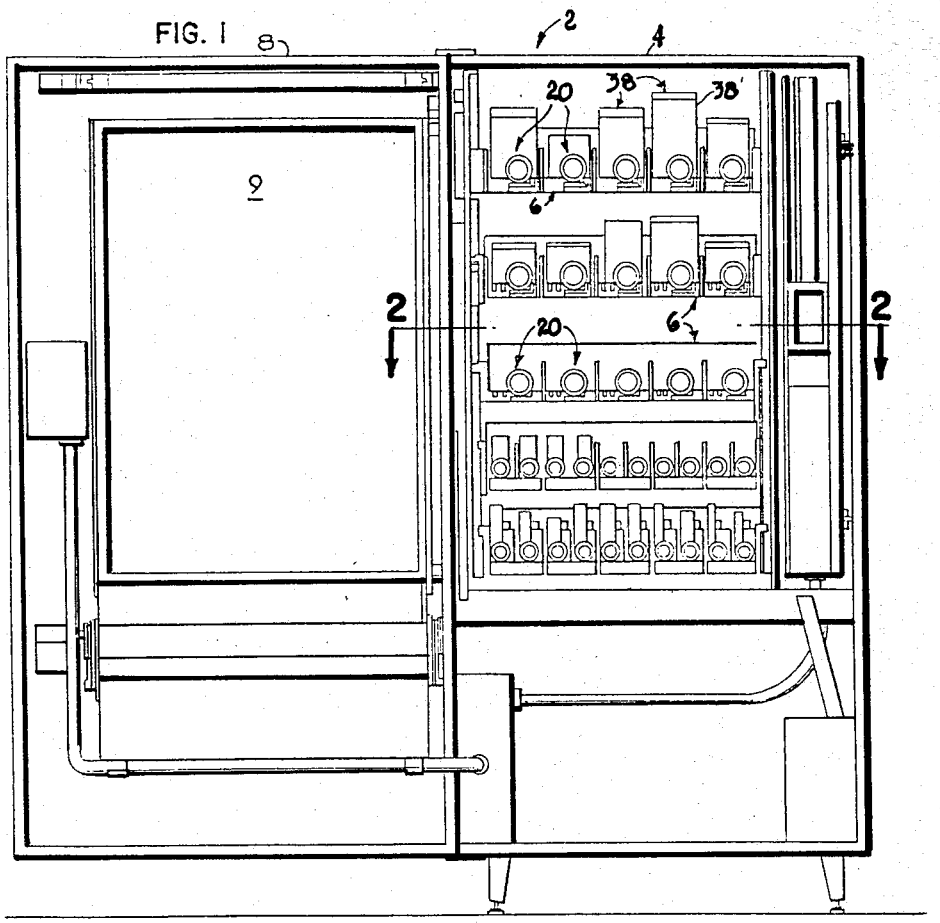
FIG. 1 is a view in front elevation of a vending machine of the present invention showing a possible arrangement of a plurality of support shelves within the vending machines and a plurality of vending coil units overlying the respective support shelves.
Figure 2:
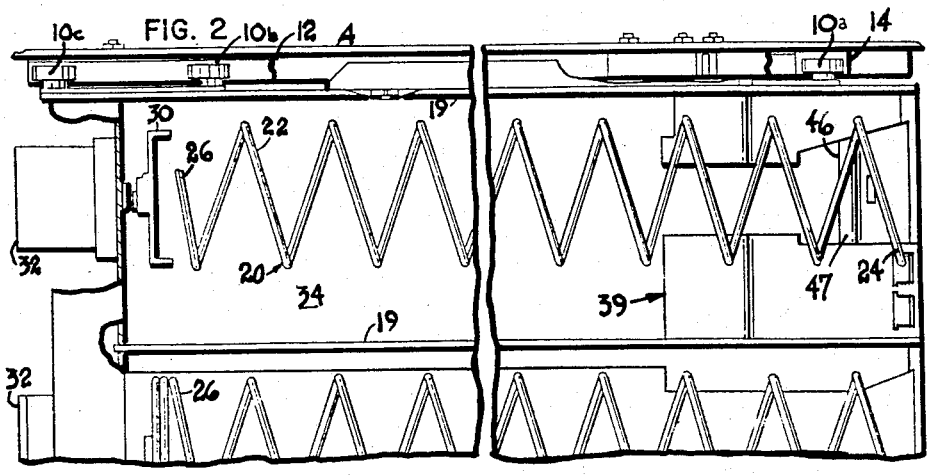
FIG. 2 is a fragmentary top plane view of a portion of one of the support shelves of the vending machine disclosed in FIG. 1, as generally viewed along the plane of lines 2—2 in FIG. 1.

Referring to the drawing, wherein like numerals represent like parts throughout the several views, and first referring to FIG. 1, the present invention is designed for use in a vending machine of a helical coil type, suitable for dispensing prepackaged food products. In particular, the present invention is designed for use in a vending machine 2 of the type disclosed in the inventor's prior patents, U.S. Pat. Nos. 4,061,245 and 4,148,412, which patents are hereby incorporated by reference. The details of such a vending machine 2 will be described herein only so for as is necessary for an understanding of the present invention.

Vending machine 2 is provided with an outer housing 4 having a plurality of vertically spaced, horizontally disposed dispensing shelves or trays 6 slidably mounted therein. Vending machine 2 also has a front door member 8, shown in its open position in FIG. 1, pivotally mounted to outer housing 4. Door member 8 is normally locked in a closed position to cover the shelves 6 contained within the internal cavity of housing 4. A window 9 is provided in door 8 so that a person contemplating the purchase of the dispensible item may view the various products contained on the shelves 6 when the door 8 is closed.

Each of the shelves 6 is movably mounted in housing 4 by a plurality of rollers 10*a*–10*c* which ride in U-shaped channels 12 attached to the sides of housing 4 so that the shelves 6 can be rolled out of housing 4 for loading food products therein. A front stop 14 is provided at the front end of each of the channels 12 for holding the shelves 6 in their normal operative position within housing 4. At least some of the shelves 6 may have additional structure allowing them to be pulled out and tilted down relative to housing 4 to ease the task of loading them with dispensible articles, as generally described in the inventor's above-referenced patents.

Each of the dispensing shelves 6 contains a plurality of transversely spaced dispensing coil units 20. Each dispensing coil unit 20 contains an elongated, generally rigid helical dispensing coil 22 extending from the front to the back of housing 4. Each coil 22 is convoluted and has a generally circular cross-section with a front portion terminating in a first terminal 24 and a rear portion terminating in a second terminal 26. The second terminal 26 and the rearmost convolutions of each coil 22 are welded or otherwise fixedly attached to a cross-bracket 30. The cross-bracket 30 of each coil is releasably coupled to an electric motor 32, operable to rotate the coil 22 in the dispensing direction (i.e. clockwise as viewed in FIG. 1). The cross-brackets 30 and the motors 32 are positioned relative to the respective shelves 6, so as to support the rearward end of the coils 22 above the planar shelf surface 34 of shelf 6, which terminates at a front edge 36. The cross-bracket and motor connections are preferably of the type disclosed in the inventor's above-referenced patents.

Figure 3:
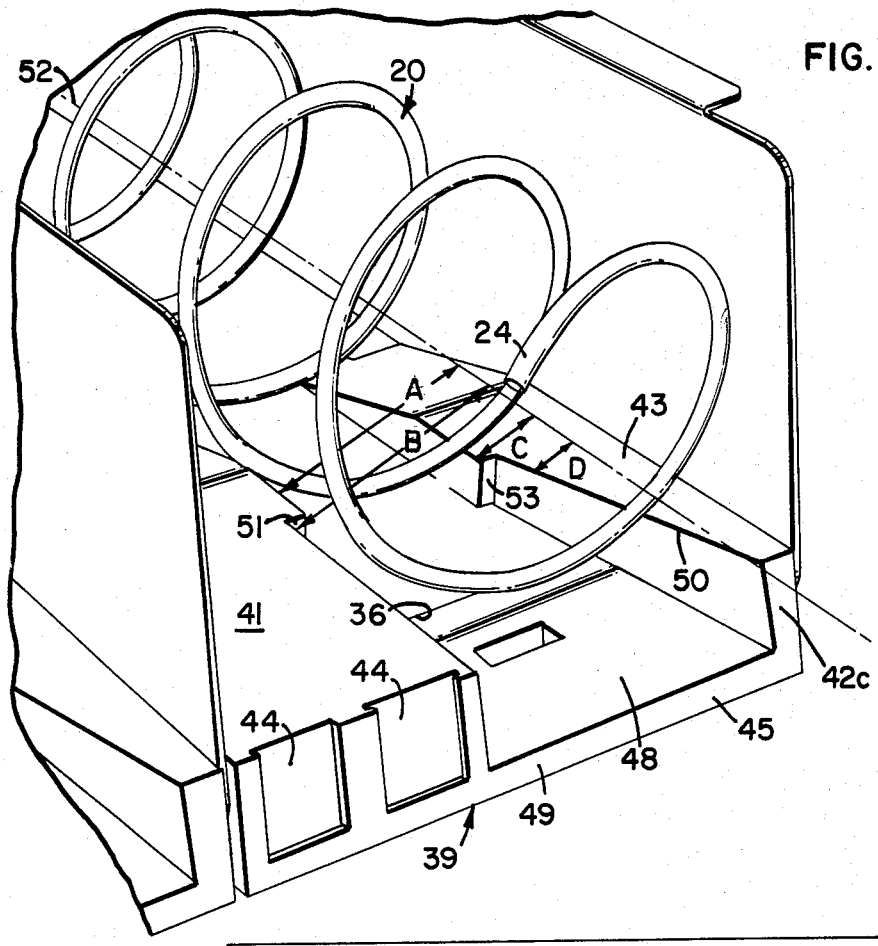
FIG. 3 is an enlarged fragmentary perspective view of a portion of a vending coil unit and its associated underlying shelf, as disclosed in FIG. 1.
Figure 4:
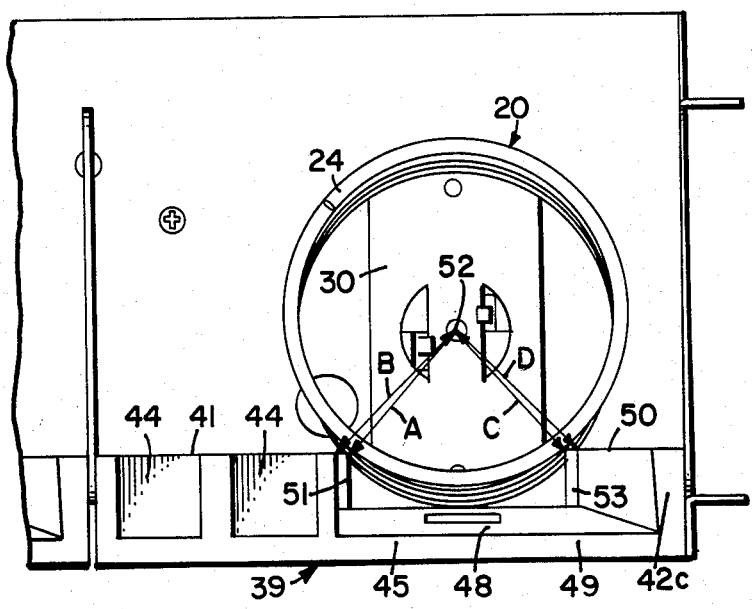
FIG. 4 is a front elevational view of the vending coil unit disclosed in FIG. 3.
Figure 5:
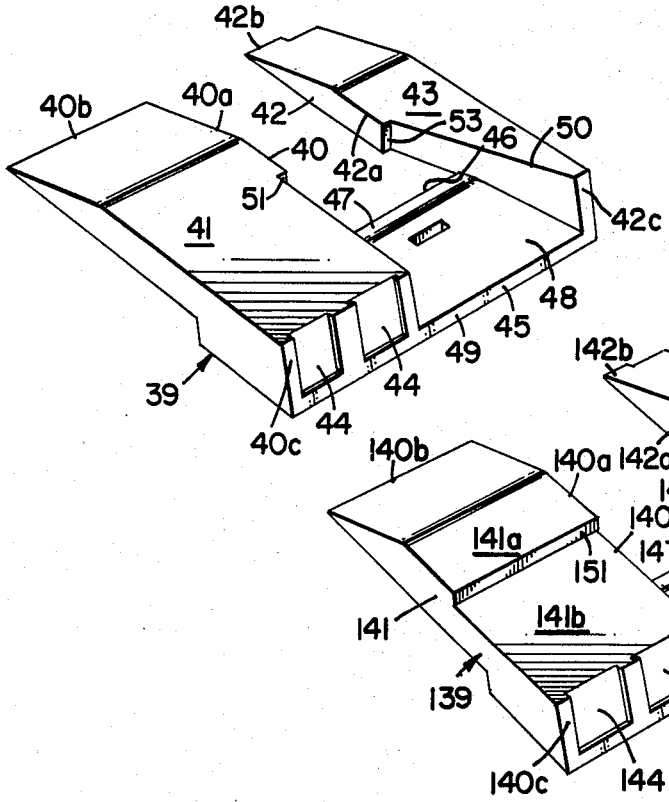
FIG. 5 is perspective of the support shelf alone, as disclosed in FIG. 3.

Referring of FIGS. 2–5, the present invention relates in particular to an improved apparatus for rotatably supporting the front end of each dispensing coil 22 at a position above and spaced from the shelf 34. In addition, at least the forwardmost convolution of the coil 22 is positioned above and spaced from a support apparatus 39. The support apparatus 39 of the preferred embodiment of the invention comprises a first elongated coil support member 40 having an upper planar surface 41 disposed generally parallel to and spaced above the shelf surface 34. A second elongated coil support member 42 defines an upper planar surface 43 disposed generally parallel to and spaced above from the shelf 34. The support members 40 and 42 are transversely spaced apart a sufficient distance so as to fit between transversely spaced sidewalls 19 which lie along the longitudinally extending sides of the dispensing coils 22 in shelf 6. The sidewalls 19 guide the food products as they are moved forwardly by coil 22 along shelf 6. Each cooperating pair of support members 40 and 42 are transversely spaced apart a sufficient distance so as to cooperatively support one of the dispensing coils 22 on the planar surfaces 41 and 43 thereof. In other words, the respective inner edges 40*a* and 42*a* of the coil supports 40 and 42 are spaced apart by distance which is somewhat less than the outer diameter of the dispensing coil 22, as shown in FIGS. 3 and 4, such that the lower surface of the coil 22 is spaced from and not in engagement with the shelf surface 34. In this application, the coils 22 are described as being supported by the upper surfaces 41 and 43. It is understood that the coils 22 typically will be supported by the inner edges 40*a* and 42*a* which are included in the upper surfaces 41 and 43 respectively.

Each of the coil support members 40 and 42 terminates at a first end 40*b* and 42*b*, respectively characterized by an upwardly inclined ramp portion which extends between the shelf surface 34 and the planar surfaces 41 and 43 of the respective support member 40 and 42. The portions 40*b* and 42*b* are operable to conveyor lift articles to be dispensed from the shelf surface 34 to the planar surfaces 41 and 43. Each of the coil support members 40 and 42 also project upwardly from the front edge 36 of the shelf 34 and terminates at a second end 40*c* and 42*c* respectively, which is spaced from the front edge 36 of the shelf 34 by a distance approximately equal to the pitch of the dispensing coil 22. The second end 40*c* of support member 40 is provided with display panels 44 for displaying price or product information regarding the items 38 being carried by the respective coil 22. The support members 40 and 42 are integrally connected at their respective ends 40*c* and 42*c* by transversely extending beam member 45. The beam member 45 is provided with a rear wall 46 adapted to matingly engage the front edge 36 of the shelf 34. A horizontal portion 47 of that top surface of the beam member 45 which lies immediately adjacent the front edge 36 of the shelf 34 forms a continuation of the shelf surface 34. A downwardly inclined ramp portion 48 leads from the horizontal portion 47 of the beam member 45 to a second end 49 of the beam member 45 to assist in the discharge of articles 38 from the vending machine 2 in a manner to be described hereafter. The second end 49 of the beam member 45 is substantially coplanar with the second ends 40*c* and 42*c* respectively of the support members 40 and 42.

The support apparatus 39 may be releasably secured to the dispensing shelf 34 by any appropriate means. In a preferred embodiment, the first and second coil support members 40 and 42 are each provided with a downwardly extending internally threaded boss (not shown) designed to receive a screw. The screw would go through the shelf 34 into the underneath side of the support apparatus 39 and engage the threaded boss.

In a preferred embodiment, the second coil support member 42 is not as wide as the first coil support member 40. The support member 42 has an outwardly beveled portion 50 along its inner edge 42*a* adjacent the entire length of the beam 45 to further assist in the discharge of articles from the machine. The support apparatus 39 is preferably integrally molded out of a hard plastic material as a one-piece unit; however, the support apparatus 39 could be formed out of other suitable materials, such as metals, if so desired.

Intermediate the first end 40*b* and the second end 40*c* of the first support member 40 is an indentation 51. The coil 22 has a center longitudinal axis 52. The perpendicular distance from the longitudinal axis 52 to the inner edge 40*a* of the support member 40 before the indentation 51, represented by A in FIGS. 3 and 4, is less than the distance from the longitudinal axis 52 to the inner edge 40*a* after the indentation 51, represented by B in FIGS. 3 and 4. The inner edge 40*a*, proximate the indentation 51, is generally in the same horizontal plane. Similarly, the inner edge 42*a* of the support member 42 has a indentation 53. The perpendicular distance from the longitudinal axis 52 to the inner edge 42*a* of the support member 42 is represented by C in FIGS. 3 and 4 and is less than the perpendicular distance from the longitudinal axis 52 to the inner edge 42*a* after the indentation 53, and is represented by D in FIGS. 3 and 4. The inner edge 42*a*, proximate the indentation 53, is generally in the same horizontal plane. It can be seen that in respect to the support member 42, that the beveled portion 50 further accentuates the distance D being greater than the distance C. It should be noted that in FIG. 3, the true relationship of the respective lengths of C and D are not accurate due to the perspective view. However, FIG. 4 clearly shows this relationship. By having the distances A and C being less than the distances B and D, during the dispensing cycle the entire front portion of the coil, i.e. at least the forwardmost convolution, is not supported by the first and second support members 40 and 42. This provides that the lower portion of the forwardmost convolution is spaced apart from the beam 45 and the support members 40 and 42.

Figure 6:
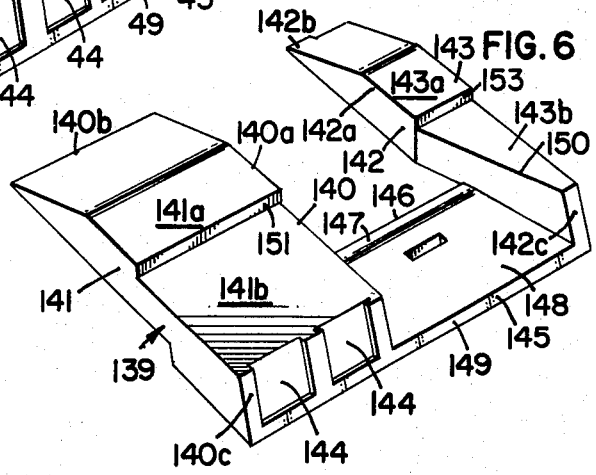
FIG. 6 is a perspective view of another embodiment of the present invention showing another shelf configuration.

Referring to FIG. 6, another embodiment of the present invention is shown. FIG. 6 illustrates a support apparatus, generally designated as 139. The support apparatus 139 comprises a first elongated coil support member 140 having an upper planar surface 141 disposed generally parallel to and spaced above the shelf 34. A second elongated coil support member 142 defines an upper planar surface 143 disposed generally parallel to and spaced above the shelf surface 34. The support members 140 and 142 are transversely spaced apart a sufficient distance so as to fit between transversely spaced sidewalls 19 which lie along the longitudinally extending sidewalls of each of the dispensing coils 22 and shelf 6. Each cooperating pair of support members 140 and 142 are transversely spaced apart a sufficient distance so as to cooperatively support one of the dispensing coils 22 on the planar surfaces 141 and 143 thereof. In other words, the respective inner edges 140*a* and 142*a* of the coil support members 140 and 142 are spaced apart by a distance which is somewhat less than the outer diameter of the dispensing coil 22, such that the lower surface of the coil 22 is spaced from and not in engagement with the shelf 34.

Each of the coil support members 140 and 142 terminates at a first end 140*b* and 142*b*, respectively, characterized by an upwardly inclined ramp portion which extends between the shelf surface 34 and the planar surfaces 141 and 143 of the respective support members 140 and 142. The portions 140*b* and 142*b* are operable to conveyor lift articles to be dispensed from the shelf surface 34 to the planar surfaces 141 and 143. Each of the coil support members 141 and 142 also project upwardly from the front edge 36 of the shelf 34 and terminates at a second end 140*c* and 142*c* respectively, which is spaced from the front edge 36 of the shelf 34 by distance approximately equal to the pitch of the dispensing coil 22. The second end 140c of the support member 140 is provided with display panels 144 for displaying price or product information regarding the items 38 being carried by the respective coil 22. The support members 140 and 142 are integrally connected at their respective ends 140c and 142c by transversely extending beam member 145. The beam member 145 is provided with a rear wall 146 adapted to matingly engage the front edge 36 of the shelf 34. A horizontal portion 147 of that top surface of the beam member 145 which lies immediately adjacent the front edge 36 of the shelf 34 forms a continuation of the shelf surface 34. A downwardly inclined ramp portion 148 leads from the horizontal portion 147 of the beam member 145 to a second end 149 of the beam member 145 to assist in the discharge of articles 38 from the vending machine in a manner to be described hereafter. The second end 149 of the beam member 145 is substantially coplanar with the second ends 140c and 142c respectively of the support members 140 and 142.

In a preferred embodiment, the second coil support member 142 is not as wide as the first coil support member 140. The support member 142 has an outwardly beveled portion 150 along its inner edge 142a adjacent the entire length of the beam 145 to further assist in the discharge of articles from the machine.

Intermediate the first end 140b and the second end 140c of the first support member 140 is a depression 151. The depression 151 provides for the upper surface 141 to have a higher portion 141a and a lower portion 141b. Similarly, the inner edge 142a of the support member 142 has a depression 153. This also provides the upper surface 143 with a higher surface 143a and a lower surface 143b. It can be seen that the net result of the depressions 151 and 153 are the same as the results from the indentations 51 and 53 of the previously described embodiment. That is, the distance from the center longitudinal axis 52 of the coil 22 to the inner edges 140a proximate the upper planar surface 141a is less than the distance from the center longitudinal axis 52 to the inner edge 140a proximate the lower planar surface 141b. Likewise, the distance from the center longitudinal axis 52 to the inner edge 142a proximate the upper planar surface 143a is less than the distance from the longitudinal axis 52 to the inner edge 142a proximate the lower planar surface 143b. Since the distances to the upper surfaces 141a and 143a is less than the distances to the lower surfaces 141b and 143b, the coil 22 will be carried by the inner edges proximate the upper surfaces 141a and 143a and will be spaced apart from the inner edges adjacent the lower planar surfaces 141b and 143b during the dispensing cycle. This is similar to the embodiment shown in FIGS. 2 through 5, wherein during the dispensing cycle, the coil 22 is supported along the upper planar surface 41 and 43 before the indentations 51 and 53, whereby the coil is spaced apart from the inner edge 40a and 42a and the beam 45 and ramp 49 for at least the forwardmost convolution of the coil 22.

Figure 7:
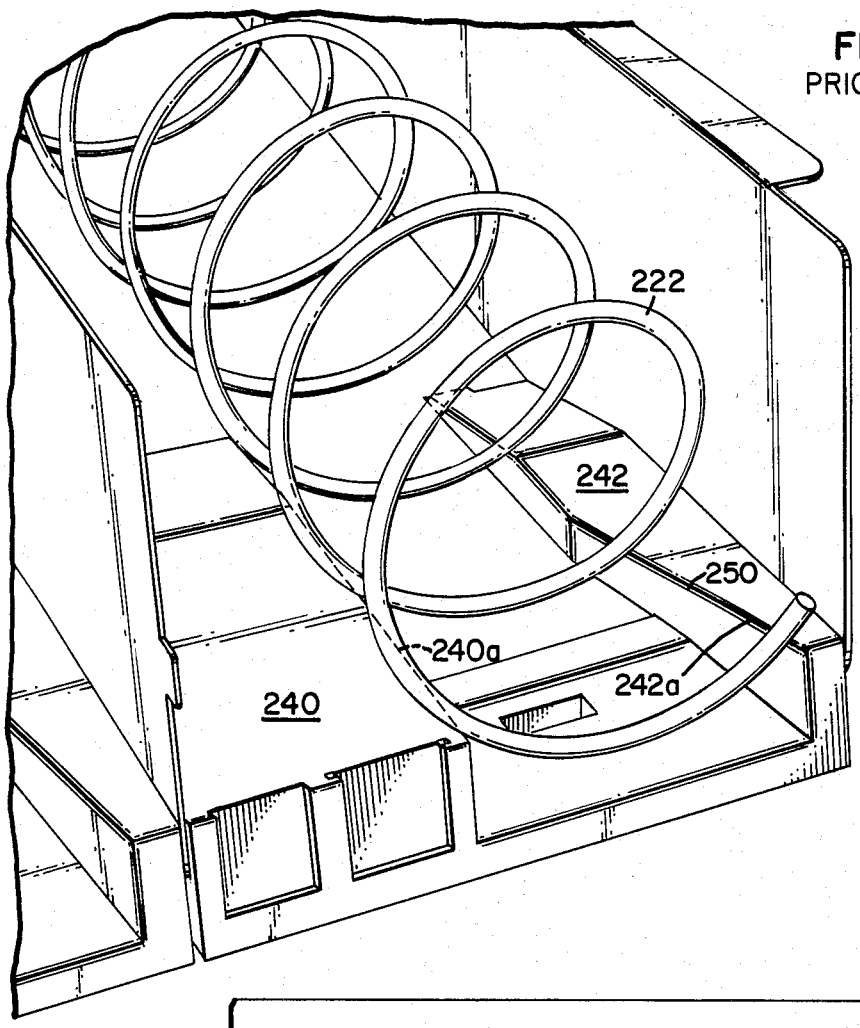
FIG. 7 PRIOR ART
FIG. 7 is an enlarged perspective view of a prior art vending coil unit and its associated underlying support shelf.
Figure 8:
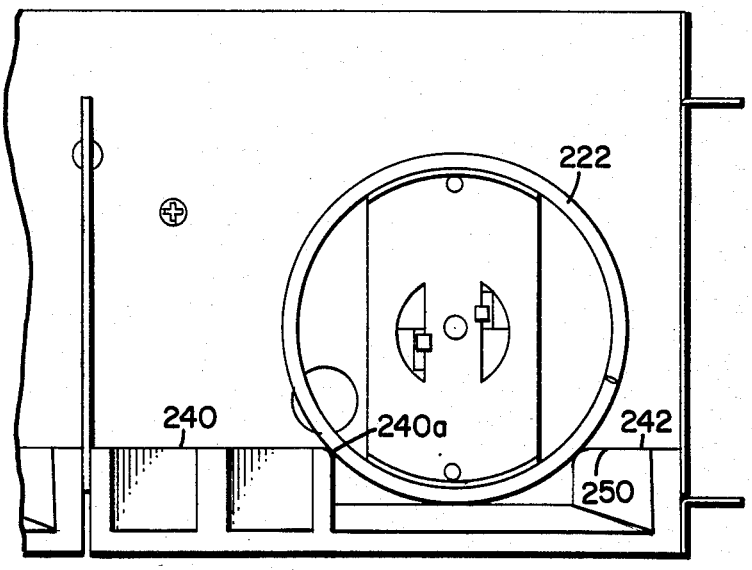
FIG. 8 PRIOR ART
FIG. 8 is a front elevational view of the prior art vending coil unit as disclosed in FIG. 7.

As can be seen in the prior art examples, shown in FIGS. 7 and 8, the helical coil 222 touches the inner edge 240a of the support 240 along the forwardmost convolution during a dispensing cycle. The beveled edge 250 may, at times, allow the forwardmost convolution to be free of the inner edge 242a of the support 242. However, this does not assist in spacing apart the forwardmost convolution to the inner edge 240a of the first support 240.

The shape of the coil support apparatus 39 and 139 described above is particularly advantageous for dispensing both large box items 38, such as cracker jacks and the like, as well as lighter weight packages or bags, such as potato chips. Normally, a support of food items 38 are supported in a longitudinal row from front to back on the shelf surface 34 between the sidewalls 19. The rotation of the coil 22 will advance the food items along the shelf during a dispensing cycle. When the advancing boxes 38 encounter the ramp portions of the first and second coil support members 40 and 42, they will be raised by continued rotation of the coil 22, from the shelf surface 34 and up to the upper planar surfaces 41 and 43. The forwardmost box/bag 38, (i.e., the next box to be dipensed) will be longitudinally retained between the last convolution of the coil 22.

When it is desired to dispense the front box/bag 38 from a particular vending coil 22, appropriate operating means (not illustrated) will cause rotation of the desired coil 22 in the dispensing direction (clockwise in FIGS. 1 and 3). Typically, the first terminal 24 is positioned at approximately 7 o'clock when the dispensing cycle begins. As the coil 22 begins rotating, the coil will urge the box/bag 38 forwardly along the upper surfaces 41 and 43 until the left side of the box/bag begins to encounter the beveled portion 50 on the second coil support member 42. As the box/bag 38 moves further forward, the left side of the box/bag will advance over an increasingly large void defined by the beleved portion 50 until that side is no longer supported by the upper surface 43. At that instance, if the weight of the box/bag item is sufficient, the left side of the box/bag will drop until it engages the downwardly inclined ramp 48. In this position, the box/bag 38 is transversely tilted about its center of mass with the left side of the box being supported by the ramp 48 and the right side of the box 38 being support by the first coil support member 40. During this time, the forwardmost convolution of the coil 22 is spaced apart from the inner edge 40a, thereby decreasing any chance that the bag will become trapped between the coil 22 and the inner edge 40a. As the dispensing cycle continues, the box/bag will tend to fall forward and to one side, thereby lessening the chances of the box/bag hanging up on the door member 8 of the vending machine 2. Further, since the forwardmost convolution of the coil 22 is spaced from the inner edge 40a and the ramp 48, there is little likelihood that the bag 38 may become trapped between the coil and the inner egde 40a or ramp 48.

Typically, the dispensing cycle is completed by the time the first terminal 24 reaches the 2 o'clock to 3 o'clock position.

Thus, the improved coil support apparatus 39 and 139 insure proper, reliable and efficient dispensing of both boxes and bags. The improved support apparatuses provide for keeping at least the forwardmost convolution of the coil 22 spaced apart from both the shelf 34, the inner edges 40a and 42a, beam 45 and ramp 48 thereby lessening the likelihood of any wedging of the article to be dispensed between the coil and support members 40 and 42, beam 45 or ramp 48.

Other modifications of the invention will be apparent to those skilled in the art in light of the foregoing description. This description is intended to provide specific examples of individual embodiments which clearly disclose the present invention. Accordingly, the invention is not limited to these embodiments or to the use of element having specific configurations and shapes as presented herein. All alternative modifications and variations of the present invention which follows in the spirit and broad scope of the appended claims are included.

I claim:

1. Support apparatus for rotatably supporting an elongated semi-rigid helical coil having a center longitudinal axis, of the type used for dispensing articles from a dispensing machine, above a substantially planar shelf surface having a front edge, comprising:

(a) a first elongated coil support member defining a first generally planar upper surface disposed to lie above and generally parallel to a shelf surface and adjacent a front edge thereof, said first upper surface being terminated at first and second longitudinally opposed ends thereof, said second end proximate the front edge;

(b) a second elongated coil support member defining a second generally planar upper surface disposed to lie above and generally parallel to said shelf surface and adjacent said front edge thereof, said second upper surface being terminated at first and second longitudinally opposed ends thereof, said second end proximate the front edge;

(c) said first and second coil support members being disposed in spaced, generally parallel relationship to one another, and wherein said first and said second coil support members are laterally spaced apart from one another a sufficient distance to cooperatively support a helical coil on and between said first and said second upper surfaces such that the lower surface of the said supported coil is disposed to lie above and spaced apart from said shelf surface; and (d) wherein said first and second coil support members each respectively has a lateral width defined by inner and outer edges thereof extending between said first and said second ends thereof, and wherein during the dispensing of the article the distances from the axis of the coil to said inner edges of said first and said second coil support members proximate where the coil is supported respectively are less than the distances from the axis of the coil to said inner edges of said first and second coil support members proximate the forwardmost convolution of the coil respectively, wherein at least the forwardmost convolution of the coil is not supported by said first and second coil support members to further assist the discharge of articles from the dispensing machine.

2. The support apparatus of claim 1, wherein said first end of said first coil support member defines a first ramp surface forming an inclined continuum in the longitudinal direction of said first coil support member between said shelf surface and said first upper surface, and wherein said first end of said second coil support member defines a second ramp surface forming an inclined continuum in the longitudional direction of said second coil support member between said shelf surface and said second upper surface and said first and said second ramp surfaces lie generally in the same plane.

3. The support apparatus of claim 1, further comprising:

(a) said first support member having a first indentation intermediate said first and second ends of said first support member, said inner edge of said first support member proximate said first indentation being generally in the same horizontal plane; and (b) said second coil support member having a second indentation intermediate said first and second ends of said second support member, said inner edge of said second support member proximate said second indentation being generally in the same horizontal plane.

4. The support apparatus of claim 1, further comprising:

(a) said first support member having a depression intermediate said first and second ends of said first support member, thereby forming said first upper surface of said first support member with a higher portion and a lower portion, said lower portion being proximate said second end of first support member; and (b) said second support member having a depression intermediate said first and second ends of said second support member, thereby forming said first upper surface of said second support member with a higher portion and a lower portion, said lower portion being proximate said second end of said second support member.

5. Support apparatus for rotatably supporting an elongated semi-rigid helical coil having a center longitudinal axis, of the type used for dispensing articles from a dispensing machine, above a substantially planar shelf surface having a front edge, comprising:

(a) a first elongated coil support member defining a first generally planar upper surface disposed to lie above and generally parallel to a shelf surface and adjacent a front edge thereof, said first upper surface being terminated at first and second longitudinally opposed ends thereof, said second end proximate the front edge, wherein said first end of said first coil support member defines a first ramp surface forming an inclined continuum in the longitudinal direction of said first coil support member between said shelf surface and said first upper surface;

(b) said first support member having a first indentation intermediate said first and second ends of said first support member, said inner edge of said first support member proximate said first indentation being generally in the same horizontal plane;

(c) a second elongated coil support member defining a second generally planar upper surface disposed to lie above and generally parallel to said shelf surface and adjacent said front edge thereof, said second upper surface being terminated at first and second longitudinally opposed ends thereof said second end proximate the front edge, wherein said first end of said second coil support member defines a second ramp surface forming an inclined continuum in the longitudional direction of said second coil support member between said shelf surface and said second upper surface;

(d) said second coil support member having a second indentation intermediate said first and second ends of said second support member, said inner edge of said second support member proximate said second indentation being generally in the same horizontal plane;

(e) said first and said second coil support members being disposed in spaced, generally parallel relationship to one another such that said first and said second ramp surfaces lie generally in the same plane, and wherein said first and said second coil support members are laterally spaced apart from one another a sufficient distance to cooperatively support a helical coil on and between said first and said second upper surfaces such that the lower surface of the said supported coil is disposed to lie above and spaced apart from said shelf surface; and (f) wherein said first and second coil support members each respectively has a lateral width defined by inner and outer edges thereof extending between said first and said second ends thereof, and wherein during the dispensing of the article the distances from the axis of the coil to said inner edges of said first and said second coil support members proximate where the coil is supported respectively are less than the distances from the axis of the coil to said inner edges of said first and second coil support members proximate the forwardmost convolution of the coil respectively, wherein at least the forwardmost convolution of the coil is spaced apart from said first and second support members.

6. Support apparatus for rotatably supporting an elongated semi-rigid helical coil having a center longitudinal axis, of the type used for dispensing articles from a dispensing machine, above a substantially planar shelf surface having a front edge, comprising:

(a) a first elongated coil support member defining a first generally planar upper surface disposed to lie above and generally parallel to a shelf surface and adjacent a front edge thereof, said first upper surface being terminated at first and second longitudinally opposed ends thereof, said second end proximate the front edge, wherein said first end of said first coil support member defines a first ramp surface forming an inclined continuum in the longitudinal direction of said first coil support member between said shelf surface and said first upper surface;

(b) said first support member having a depression intermediate said first and second ends of said first support member, thereby forming said first upper surface of said first support member with a higher portion and a lower portion, said lower portion being proximate said second end of said first support member;

(c) a second elongated coil support member defining a second generally planar upper surface disposed to lie above and generally parallel to said shelf surface and adjacent said front edge thereof, said second upper surface being terminated at a first and second longitudinally opposed ends thereof said second end proximate the front edge, wherein said first end of said second coil support member defines a second ramp surface forming an inclined continuum in the longitudional direction of said second coil support member between said shelf surface and said second upper surface;

(d) a second support member having a depression intermediate said first and second ends of said second support member, thereby forming said first upper surface of said second support member with a higher portion and a lower portion, said lower portion being proximate said second end of said second support member;

(e) said first and said second coil support members being disposed in spaced, generally parallel relationship to one another such that said first and said second ramp surfaces lie generally in the same plane, and wherein said first and said second coil support members are laterally spaced apart from one another a sufficient distance to cooperatively support a helical coil on and between said first and said second upper surfaces such that the lower surface of the said supported coil is disposed to lie above and spaced apart from said shelf surface; and (f) wherein said first and second coil support members each respectively has a lateral width defined by inner and outer edges thereof extending between said first and said second ends thereof, and wherein during the dispensing of the article the distances from the axis of the coil to said inner edges of said first and said second coil support members proximate where the coil is supported respectively are less than the distances from the axis of the coil to said inner edges of said first and second coil support members proximate the forwardmost convolution of the coil respectively, wherein at least the forwardmost convolution of the coil is spaced apart from said first and second support members.

* * * * *